US010704186B2

(12) United States Patent
Jang

(10) Patent No.: US 10,704,186 B2
(45) Date of Patent: Jul. 7, 2020

(54) LAUNDRY TREATMENT APPARATUS AND METHOD OF CONTROLLING THE SAME

(71) Applicant: LG ELECTRONICS INC., Seoul (KR)

(72) Inventor: Yongwoon Jang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 261 days.

(21) Appl. No.: 15/670,490

(22) Filed: Aug. 7, 2017

(65) Prior Publication Data

US 2018/0038030 A1 Feb. 8, 2018

(30) Foreign Application Priority Data

Aug. 8, 2016 (KR) ..... 10-2016-0100807

(51) Int. Cl.
*D06F 39/10* (2006.01)
*D06F 23/04* (2006.01)
(Continued)

(52) U.S. Cl.
CPC ..... *D06F 39/10* (2013.01); *D06F 23/04* (2013.01); *D06F 37/02* (2013.01); *D06F 37/26* (2013.01);
(Continued)

(58) Field of Classification Search
CPC ..... D06F 23/04; D06F 37/40; D06F 39/10
See application file for complete search history.

(56) References Cited

U.S. PATENT DOCUMENTS 4,554,805 A 11/1985 Hirooka et al.
5,661,989 A * 9/1997 Jeon ..... D06F 39/10 68/18 F
(Continued)

FOREIGN PATENT DOCUMENTS

CN 2692184 4/2005
CN 101338506 1/2009
(Continued)

OTHER PUBLICATIONS

International Search Report and Written Opinion issued in Application PCT/KR2017/008447 dated Dec. 5, 2017.
(Continued)

*Primary Examiner* — Joseph L. Perrin
(74) *Attorney, Agent, or Firm* — KED & Associates LLP

(57) ABSTRACT

A method of controlling a laundry treatment apparatus is disclosed. The method includes rotating the drum only in one direction among a clockwise direction and a counter-clockwise direction so as to separate water from water contained in the drum, supplying water to the tub, rotating only the agitator to an angle less than 360 degrees so as to disperse laundry in the drum, rotating only the rotator to an angle of 360 degrees or more at a rotational speed that is higher than a rotational speed of the agitator set for the dispersion operation so as to supply water to the chamber, filtering water through the filter, and rotating only the agitator to an angle less than 360 degrees at a rotational speed that is higher than the rotational speed of the agitator set for the dispersion operation but is lower than the rotational speed set for the filtering operation.

16 Claims, 3 Drawing Sheets

(51) Int. Cl.

| | |
|---|---|
| ***D06F 37/02*** | (2006.01) |
| ***D06F 37/26*** | (2006.01) |
| ***D06F 37/40*** | (2006.01) |
| *D06F 39/08* | (2006.01) |
| *D06F 25/00* | (2006.01) |
| *D06F 29/00* | (2006.01) |
| *D06F 35/00* | (2006.01) |

(52) U.S. Cl.
CPC ..... *D06F 25/00* (2013.01); *D06F 29/00* (2013.01); *D06F 35/00* (2013.01); *D06F 37/40* (2013.01); *D06F 39/083* (2013.01)

(56) References Cited

U.S. PATENT DOCUMENTS

| | | | | |
|---|---|---|---|---|
| 5,849,182 | A * | 12/1998 | Shin | B01D 29/05 210/167.01 |
| 5,941,100 | A | 8/1999 | Ahn et al. | |
| 5,989,418 | A * | 11/1999 | Shin | D06F 39/10 210/136 |
| 6,076,378 | A * | 6/2000 | Shin | D06F 39/10 68/18 F |
| 2008/0196452 | A1* | 8/2008 | Bae | D06F 39/10 68/18 F |
| 2008/0217243 | A1 | 9/2008 | Yoo | |
| 2011/0047714 | A1 | 3/2011 | Kim et al. | |
| 2014/0026624 | A1* | 1/2014 | Oh | D06F 39/083 68/18 F |
| 2014/0102154 | A1* | 4/2014 | Lee | D06F 39/10 68/18 F |
| 2015/0040620 | A1* | 2/2015 | Jeong | D06F 13/02 68/18 FA |
| 2016/0130741 | A1* | 5/2016 | Kim | D06F 39/10 8/137 |

FOREIGN PATENT DOCUMENTS

| | | |
|---|---|---|
| CN | 103492628 | 1/2014 |
| CN | 104695168 | 6/2015 |
| CN | 20500143 | 1/2016 |
| GB | 2 285 063 | 6/1995 |
| JP | 8-57186 | 3/1996 |
| JP | H 0956986 | 3/1997 |
| JP | 2006-223572 | 8/2006 |
| JP | 2009-000197 | 1/2009 |
| KR | 10-0218970 | 9/1999 |
| KR | 10-2004-0102508 | 12/2004 |

OTHER PUBLICATIONS

International Search Report issued in Application PCT/KR2017/008460 dated Oct. 31, 2017.
Chinese Office Action dated Jun. 28, 2019 issued in Application 201710670304.2 (and full English Translation).
Chinese Office Action dated Jun. 14, 2019 issued in Application 201710670146.0 (full Chinese text and English Translation).
U.S. Office Action dated Jun. 27, 2019 issued in co-pending U.S. Appl. No. 15/670,517.

* cited by examiner

LAUNDRY TREATMENT APPARATUS AND METHOD OF CONTROLLING THE SAME

CROSS-REFERENCE TO RELATED APPLICATION

This application claims priority under 35 U.S.C. § 119 to Korean Application No. 10-2016-0100807 filed on Aug. 8, 2016, whose entire disclosure is hereby incorporated by reference.

BACKGROUND

1. Field

The present invention relates to a laundry treatment apparatus and a method of controlling the same.

2. Background

A conventional laundry treatment apparatus includes a tub for containing water therein, a drum rotatably disposed in the tub so as to contain laundry therein, an agitator rotatably disposed in the drum, a chamber for discharging the water in the drum to the outside of the drum and supplying the water to the inside of the drum again, and a filter for filtering the water introduced into the chamber.

The conventional laundry treatment apparatus, which is constructed as mentioned above, performs a washing operation of rotating the agitator so as to remove impurities from laundry and a dewatering operation of rotating the drum so as to separate water from the laundry. Furthermore, the laundry treatment apparatus controls the number of revolutions per unit time (e.g., RPM, hereinafter referred to as 'rotational speed') of the agitator so as to circulate the water in the drum through the chamber and to thus filter the water. Accordingly, the washing performance, the rinsing performance and the filtering performance of the conventional laundry treatment apparatus are considered to be determined in large part based on the rotational speed of the agitator.

In other words, in the conventional laundry treatment apparatus, in order to improve the washing performance or the rinsing performance, the rotational speed of the agitator is increased so as to create a forceful water flow in the drum, and, in order to improve the filtering performance, the rotational speed of the agitator is increased so as to cause a large amount of water to pass through the filter.

Increasing the rotational speed of the agitator enables the improvement of the washing performance or the rinsing performance. However, in this case, there is a problem in that laundry is tangled in the drum due to water flow, and impurities (contaminants, lint and the like) separated from laundry are trapped in spaces defined in the tangled laundry, thereby making it difficult to improve the filtering performance.

Furthermore, when the rotational speed of the agitator is decreased in the washing operation or the rinsing operation, there is a problem in that the washing performance or the rinsing performance is deteriorated, and impurities thus cannot be separated from laundry, thereby deteriorating the filtering performance.

In addition, the conventional laundry treatment apparatus has a problem whereby lint, which is separated from laundry in the washing operation or the rinsing operation, remains in the laundry after a water discharge operation. Conventional laundry treatment apparatuses may be classified into a laundry treatment apparatus employing a drum, which is rotated about a rotating axis parallel to the ground, and a laundry treatment apparatus employing a drum, which is rotated about a rotating axis perpendicular to the ground, with an agitator, which is rotated in the drum. The problem whereby lint remains in laundry after a water discharge operation may more frequently occur in the apparatus employing the agitator.

While the laundry treatment apparatus employing the drum, which is rotated about the rotating axis parallel to the ground, rarely generates lint because impurities are separated when laundry falls, the laundry treatment apparatus employing the agitator may generate lint during separation of impurities by friction between the agitator and the laundry.

Because the lint, which is separated from laundry during a washing or rinsing operation, remains in the state of floating in water or is trapped in spaces defined in the laundry, the lint may remain in the laundry treatment apparatus or the laundry during the water discharge operation.

BRIEF DESCRIPTION OF THE DRAWINGS

The embodiments will be described in detail with reference to the following drawings in which like reference numerals refer to like elements wherein.

DETAILED DESCRIPTION

Reference will now be made in detail to the preferred embodiments of the present invention, examples of which are illustrated in the accompanying drawings. It should be noted herein that the construction of an apparatus, which will hereinafter be described, and a method of controlling the apparatus are given only for illustrative purposes and the protection scope of the invention is not limited thereto. Wherever possible, the same reference numbers will be used throughout the drawings to refer to the same or like parts.

Figure 1:
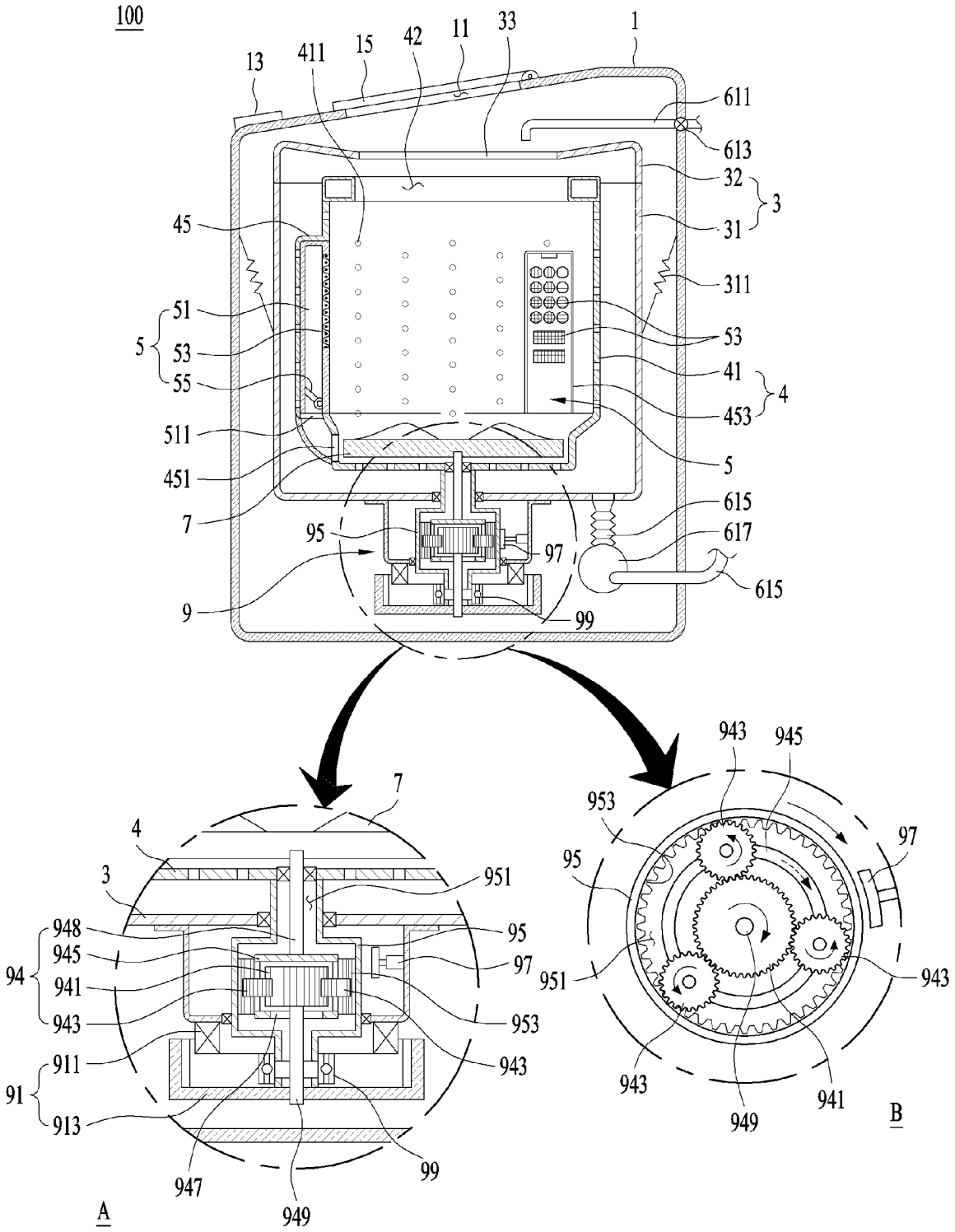
FIG. 1 illustrates an example of a laundry treatment apparatus according to the present invention.

As illustrated in FIG. 1, a laundry treatment apparatus 100 according to the present invention includes a cabinet 1, a tub 3 disposed inside the cabinet 1 so as to contain water therein, a drum 4 rotatably disposed inside the tub 3 and having a space for containing laundry, a filter unit 5 for filtering the water discharged from the drum 4 and then introducing the filtered water into the drum 4, an agitator 7 rotatably disposed inside the drum 4 so as not only to create water flow but also to supply water to the filter unit 5, and a driving unit 9 for rotating the agitator 7 and the drum 4.

The cabinet 1 may be constructed so as to define the appearance of the laundry treatment apparatus, and may be provided on the upper surface thereof with a cabinet port 11 through which laundry is put into and taken out of the apparatus. The cabinet port 11 may be opened and closed by a door 15, which is rotatably provided on the upper surface of the cabinet 1. Furthermore, the cabinet 1 may be provided with a control panel 13 for controlling the laundry treatment apparatus 100.

The control panel 13 may include an input unit (not shown) through which control commands are input by a user, and a display unit (not shown) for displaying control commands, which is selectable by the user, and execution progress of the control commands.

The tub 3 may include a tub body 31 secured inside the cabinet 1 via tub supports 311, and a tub cover 32 defining the upper surface of the tub body 31.

Although the tub body 31 may be configured to have any shape as long as it can contain water therein, the tub body 31 is preferably configured to have a cylindrical shape because the drum 4 must be rotatable in the tub 3.

The tub supports 311 are preferably constructed so as to attenuate vibrations generated in the tub 3. Examples of the tub supports 311 may include springs, dampers and the like.

The tub cover 32 is provided with a tub port 33 through which the inside of the tub body 31 communicates with the outside of the tub body 31. The tub port 33 is preferably positioned below the cabinet port 11.

The tub 3 receives water from a water supply unit, and discharges the water contained in the tub 3 to the outside through a water discharge unit. The water supply unit may include a water supply pipe 611, connected to a water supply source (not shown), and a valve 613, adapted to open and close the water supply pipe 611. The water discharge unit may include a pump 617 for discharging the water in the tub body 31 and a water discharge pipe 615 for guiding the water discharged from the pump 617 to the outside of the cabinet 1.

The drum 4 includes a drum body 41 disposed inside the tub body 31 so as to contain laundry, and a drum port 42 provided on the upper surface of the drum body 41. Although the drum body 41 may be configured to have any shape capable of providing a space for containing laundry, the drum body 41 is preferably configured to have a cylindrical shape in consideration of vibration during rotation thereof.

The circumferential wall and bottom wall of the drum body 41 are provided with a plurality of through holes 411 through which the inside of the drum body 41 communicates with the inside of the tub body 31. Accordingly, the water contained in the tub 3 may be introduced into the inside of the drum body 41, and the water contained in the drum body 41 may be discharged to the tub body 31 through the through holes 411.

The drum body 41 communicates with the outside of the cabinet 1 through the drum port 42, the tub port 33 and the cabinet port 11. Therefore, laundry may be introduced into the drum body 41 through the drum port 42, and the laundry contained in the drum body 41 may be taken out of the cabinet 1 through the drum port 42.

The circumferential surface of the drum body 41 is provided with a chamber 45. The chamber 45 may be embodied as a flow channel through which the water contained in the drum body 41 is discharged to the outside and the discharged water is supplied to the drum body 41 again.

In this case, the chamber 45 may be provided with a first through hole 451 and a second through hole 453, both of which communicate with the inside of the drum body 41. The first through hole 451 may be provided as means for introducing the water in the drum body 41 into the chamber 45, and the second through hole 453 may be provided as means for discharging the water in the chamber to the inside of the drum body 41.

The first through hole 451 and the second through hole 453 may be provided at any position in the drum body 41 as long as they are able to fulfill the above functions. FIG. 1 illustrates an embodiment in which the first through hole 451 is provided at a lower region of the circumferential wall of the drum body 41 and the second through hole 453 is provided at the circumferential wall of the drum body 41.

Preferably, the first through hole 451 is spaced apart from the peripheral edge of the agitator 7 by a predetermined distance in the state of being positioned at a level equal to or below the upper surface of the agitator 7 such that water made to flow by the agitator 7 is introduced into the chamber 45. In other words, the top end of the first through hole 451 is preferably positioned at a level equal to or below the upper surface of the agitator 7.

The filter unit 5, which is provided at the chamber 45 so as to filter water, may be detachably provided at the second through hole 453.

In this case, the filter unit 5 may include a filter housing 51 detachably coupled to the second through hole 453, an introduction opening 511, which communicates with the first through hole 451 so as to allow the introduction of water into the filter housing 51, and a filter 53 secured to the filter housing 51 so as to filter the water introduced into the filter housing 51.

Because the second through hole 453 is provided at a level higher than the first through hole 451, and the filter housing 51 is provided in the second through hole 453, the filter 53 is positioned at a level higher than the upper surface of the agitator 7. Accordingly, the water in the drum body 41 will be raised to the level of the filter 53 only when the number of revolutions per unit time (e.g., RPM, hereinafter referred to as 'rotational speed') of the agitator 7 exceeds a predetermined value.

In addition, the filter housing 51 may be provided therein with a check valve 55 for preventing impurities (contaminants, lint and the like separated from laundry), which are filtered by the filter 53, from being introduced into the drum body 41 again.

Unlike the above embodiment, the filter unit 5 may also be constituted by only the filter 53 provided in the second through hole 453.

The agitator 7 may be configured to have any shape as long as it is able to create water flow in the tub body 31 or the drum body 41. FIG. 1 illustrates an embodiment in which the agitator 7 is configured to have a disk shape.

In the laundry treatment apparatus 100 having the above-described structure, the drum body 41 and the agitator 7 are rotated by the driving unit 9.

The driving unit 9 illustrated in FIG. 1 may rotate only the agitator 7 or may rotate the agitator 7 concurrently with the drum 4.

In this embodiment, the driving unit 9 may include a drum-rotating shaft 95 for rotating the drum 4, an agitator-rotating shaft 94, which extends through the drum-rotating shaft 95 so as to rotate the agitator 7, a motor 91 for rotating the agitator-rotating shaft 94, and a clutch 99 for transmitting the rotative force, generated from the motor 91, to the drum-rotating shaft 95.

The motor 91 may include a stator 911 secured to the outer surface of the tub body 31 and a rotor 913 adapted to be rotated by the rotating magnetic field generated by the stator 911.

The drum-rotating shaft 95 extends through the bottom wall of the tub body 31 and is secured to the bottom surface of the drum body 41. The drum-rotating shaft 95 is provided therein with a shaft hole 951, which is longitudinally formed along the drum-rotating shaft 95, and a connecting gear 953 provided in the shaft hole 951.

The agitator-rotating shaft 94 may include a first shaft 949 disposed in the shaft hole 951 and fixed to the rotor 913, a drive gear 941 rotatably disposed in the shaft hole 951 and fixed to the first shaft 949, a plurality of driven gears 943 disposed along the circumferential surface of the drive gear 941 so as to connect the drive gear 941 to the connecting gear 953, a cage 945 rotatably disposed in the shaft hole 951 so as to rotatably support the plurality of driven gears 943, and a second shaft 948 for connecting the upper surface of the cage 945 to the agitator 7.

The second shaft 948 is fixed at one end thereof to the upper surface of the cage 945, and is fixed at the other end thereof to the agitator 7 through the bottom wall of the drum body 41.

The clutch 99, which is means for connecting the drum-rotating shaft 95 to the rotor 913, is constructed so as to be reciprocated between the drum-rotating shaft 95 and the rotor 913 by a separate clutch drive (not shown).

The rotor 913 is provided with a clutch coupler (not shown) for coupling the rotor 913 to the clutch 99 in a gear engagement manner, and the drum-rotating shaft 95 is provided on the outer circumferential surface thereof with a clutch coupler (not shown) for coupling the drum-rotating shaft 95 to the clutch 99 in a gear engagement manner. Consequently, when the clutch 99 connects the drum-rotating shaft 95 to the rotor 913 by means of the clutch drive, the drum-rotating shaft 95 is rotated together with the rotor 913 upon rotation of the rotor 913.

In the laundry treatment apparatus 100 having the above-described structure, when the clutch 99 connects the rotor 913 to the drum-rotating shaft 95, the drum 4 and the agitator 7 are concurrently rotated in the same direction (A).

For example, when the rotor 913 is rotated in a clockwise direction while the clutch 99 connects the rotor 913 to the first shaft 949 as illustrated in A of FIG. 1, the drum-rotating shaft 95 is rotated in the clockwise direction, and the drum 4 is thus rotated in the clockwise direction.

When the rotor 913 is rotated as illustrated in B of FIG. 1, the first shaft 949 and the drive gear 941 are rotated in the clockwise direction. When the drive gear 941 is rotated in the clockwise direction, the driven gears 943 are rotated in the counterclockwise direction, and the cage 945 is rotated in the clockwise direction. Accordingly, the second shaft 948, which is fixed to the cage 945, is also rotated in the clockwise direction, and the agitator 7 is rotated in the clockwise direction by the second shaft 948.

Meanwhile, when the rotor 913 is rotated in the clockwise direction while the clutch 99 releases the coupling between the rotor 913 and the first shaft 949, the agitator 7 is rotated in the clockwise direction by the above-mentioned procedure, and the drum 4 is rotated in the counterclockwise direction (not shown). The reason why the drum-rotating shaft 95 is rotated even when the clutch 99 does not connect the rotor 913 to the drum-rotating shaft 95 is because repulsive force acts on the connecting gear 953 during rotation of the driven gears 943.

The driving unit 9 may further include a brake 97 for preventing the rotation of the drum-rotating shaft 95 when the rotor 913 is rotated while the clutch 99 releases the coupling between the rotor 913 and the first shaft 949. The brake 97 may be constructed to be brought into contact with the drum-rotating shaft 95 by a brake drive (not shown).

When the brake 97 presses the drum-rotating shaft 95 so as to inhibit the rotation of the drum-rotating shaft 95 while the rotor 913 is rotated in the state in which the clutch 99 releases the coupling between the rotor 913 and the first shaft 949, only the agitator 7 is rotated during the rotation of the rotor 913.

Differing from the above construction, the driving unit 9 may be constructed by a motor for controlling only the rotation of the agitator and a motor for controlling the rotation of the drum 4.

The laundry treatment apparatus having the above-described structure separates impurities from laundry by rotating the agitator 7, and separates water from the laundry by rotating the drum 4. Furthermore, the laundry treatment apparatus causes the water in the drum 4 to be circulated through the chamber 45 by increasing the rotational speed of the agitator 7, thereby filtering contaminants and lint contained in the water. Accordingly, the washing performance, the rinsing performance and the filtering performance of the laundry treatment apparatus 100 may be determined by the rotational speed of the agitator 7.

Specifically, in order to improve the washing performance or the rinsing performance, the controller (not shown) increases the rotational speed of the agitator 7 so as to create a forceful water flow in the drum 4. Meanwhile, in order to improve the filtering performance, the controller increases the rotational speed of the agitator 7 so as to cause a large amount of water to pass through the filter 53.

Therefore, the increase of rotational speed of the agitator 7 results in the improvement of washing performance or rinsing performance but causes laundry to be tangled in the drum 4 due to the forceful water flow. However, when the laundry is in the state of being tangled, contaminants and lint are trapped in the internal space in the tangled laundry, thereby making it difficult to improve the filtering performance, which is problematic.

Meanwhile, the decrease in the rotational speed of the agitator 7 results in the deterioration of the washing performance or the rinsing performance, and makes it impossible to separate impurities from laundry, thereby causing a problem whereby the filtering performance is deteriorated.

Figure 2:
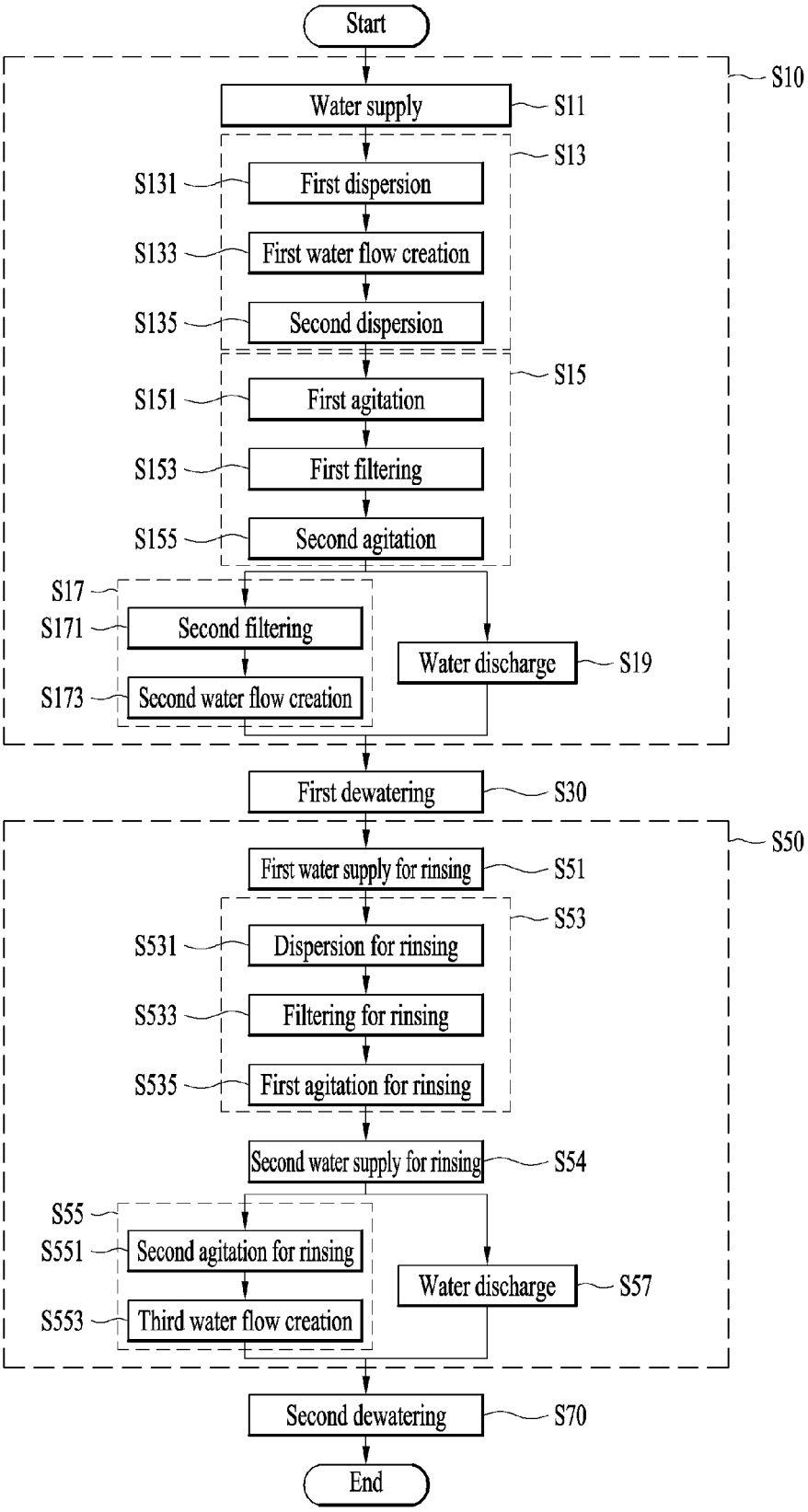
FIG. 2 illustrates an example of a method of controlling the laundry treatment apparatus according to the present invention.

A method of controlling the laundry treatment apparatus according to the present invention illustrated in FIG. 2 is intended to solve the above-mentioned problems. The method of controlling the laundry treatment apparatus may include a washing operation S10, an intermediate dewatering operation (a first dewatering operation) S30, a rinsing operation S50 and a dewatering operation (a second dewatering operation) S70.

The washing operation S10, which is intended to supply water and detergent to the tub 3 so as to remove impurities (contaminants, lint and the like) from laundry, may include a water supply operation S11, a first motion execution operation S13, a second motion execution operation S15, a third motion execution operation S17 and a water discharge operation S19.

The water discharge operation S11 is intended to perform control of the valve 613 by a controller (not shown) so as to supply water to the tub 3.

The first motion execution operation S13 is intended to execute motion for improving washing performance. The first motion execution operations S13 includes a first water flow creation operation S133 of rotating the drum 4 and the agitator 7 in the same direction so as to create water flow in the tub 3.

Figure 3:
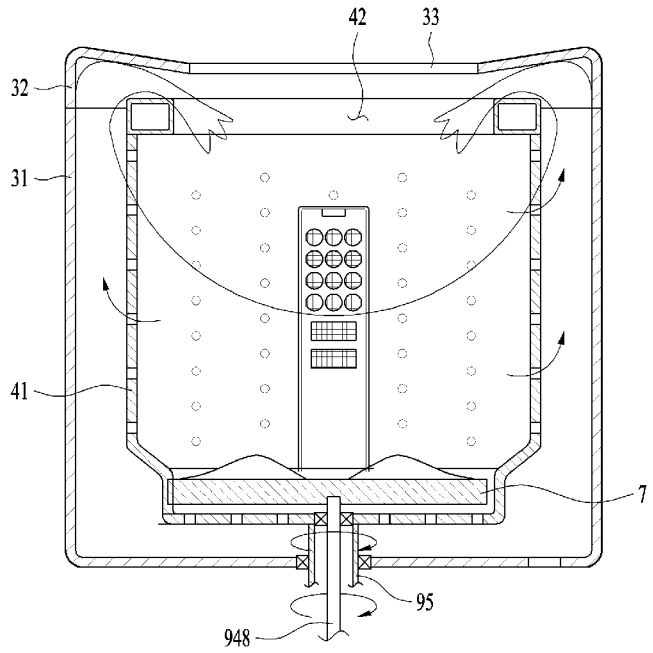
FIG. 3 illustrates an example of an operation of creating water flow.

In the first water flow creation operation S133, the drum 4 and the agitator 7 are constructed so as to be rotated one revolution or more (rotation of 360 degrees or more) in one direction selected from among the clockwise direction and the counterclockwise direction. In other words, the first water flow creation operation S133 is a process of raising the water in the tub body 31 to the tub cover 32 to allow the water to be introduced into the drum body 41 through the drum port 42, as illustrated in FIG. 3.

In the first water flow creation operation S133, since laundry comes into frictional contact with flowing water and adjacent laundry and collides with water falling through the drum port 42, the method according to the present invention is able to easily remove impurities from the laundry through the first water flow creation operation S133.

However, because there is high possibility that the laundry remains in the state of being tangled in the drum body 41 during the first water flow creation operation S133, the first motion execution operation S13 may further include at least one of a first dispersion operation S131 performed before the initiation of the first water flow creation operation S133 and a second dispersion operation S135 performed after the completion of the first water flow creation operation S133.

As illustrated in FIG. 2, the first dispersion operation S131 is intended to disperse laundry in the drum body 41 before the initiation of the first water flow creation operation S133 so as to minimize the possibility of the laundry becoming tangled during execution of the first water flow creation operation S133.

The first dispersion operation S131 is a process of rotating only the agitator to an angle less than 360 degrees. The rotational speed of the agitator 7 in the first dispersion operation S131 is preferably set to be lower than the rotational speed set to the first water flow creation operation S133.

In order to uniformly disperse laundry in the drum body 41, the first dispersion operation S131 may include an operation of rotating only the agitator 7 to an angle less than 360 degrees in the clockwise direction, and an operation of rotating only the agitator 7 to an angle less than 360 degrees in the counterclockwise direction.

The second dispersion operation S135 is a process of untangling the tangled laundry after completion of the first water flow creation operation S133. In the second dispersion operation S135, the controller rotates only the agitator 7 to an angle less than 360 degrees.

In the second dispersion operation S135, the rotational speed of the agitator 7 is preferably set to be lower than the rotational speed set to the first water flow creation operation S133. The second dispersion operation S135 may also include an operation of rotating only the agitator 7 to an angle less than 360 degrees in the clockwise direction, and an operation of rotating only the agitator to an angle less than 360 degrees in the counterclockwise direction.

In the first motion execution operation S13, the first dispersion operation S131, the first water flow creation operation S133 and the second dispersion operation S135 are preferably performed in sequence. The first motion execution operation S13 may be performed twice or more. The first motion execution operation S13 is preferably performed immediately after the completion of the water supply operation S11, and is performed for 10%-30% of the period of time taken to perform the entire washing operation S10.

After the completion of the first motion execution operation S13, the method according to the present invention performs the second motion execution operation S15.

The second motion execution operation S15, which is a process of transferring contaminants, lint and the like, which are separated from laundry and contained in the water, to the filter unit 5, includes a first filtering operation S153.

The first filtering operation S153 is a process of rotating only the agitator 7 one revolution or more (rotation of 360 degrees or more) so as to supply water to the filter 53.

Figure 4:
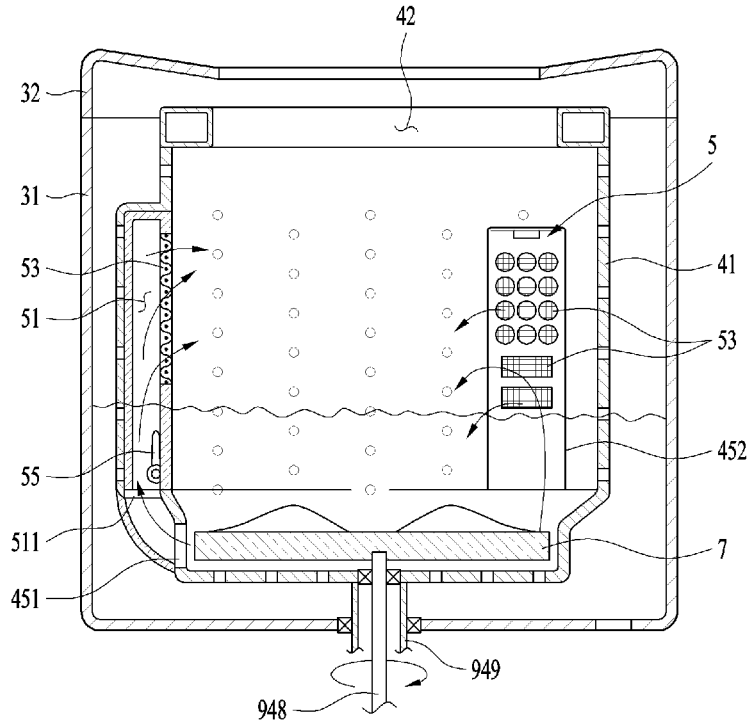
FIG. 4 illustrates an example of a filtering operation.

As illustrated in FIG. 4, in the first filtering operation S153, the agitator 7 is rotated only in one direction selected from among the clockwise direction and the counterclockwise direction, and the rotational speed of the agitator 7 should be set so as to create sufficient water pressure to raise water to the level of the filter 53. In other words, the rotational speed of the agitator 7 set for the first filtering operation S153, is preferably lower than the rotational speed set for the first water flow creation operation S133, but is preferably higher than the rotational speed set for the dispersion operations S131 and S135.

Since a relatively forceful water flow is created in the drum body 41 during the first filtering operation S153, the second motion execution operation S15 may further include at least one of a first agitating operation S151, which is performed before the initiation of the first filtering operation S153, and a second agitating operation S155, which is performed after the completion of the first filtering operation S153.

The first agitating operation S151 is a process not only of creating water flow in the drum body 41 before the initiation of the first filtering operation S153 so as to provide laundry with a frictional force but also of uniformly dispersing the laundry in the drum body 41 so as to minimize the possibility of the laundry becoming tangled during the first filtering operation S153.

To this end, in the first agitating operation S151, only the agitator 7 is rotated to an angle less than 360 degrees, and the rotational speed of the agitator 7 set for the first agitating operation S151, is set to be higher than the rotational speed set for the dispersion operations S131 and S135, but is set to be lower than the rotational speed set for the first filtering operation S153. Accordingly, in the first agitating operation S151, the water in the drum body 41 may not be supplied to the filter 53.

The second agitating operation S155 is a process of untangling the tangled laundry in the drum body 41 after the completion of the first filtering operation S153. In the second agitating operation S155, the controller rotates only the agitator 7 to an angle less than 360 degrees, and the rotational speed of the agitator 7 set for the second agitating operation S155, may be set to be higher than the rotational speed of the agitator 7 set for the dispersion operations S131 and S135, but may be set to be lower than the rotational speed of the agitator 7 set for the first filtering operation S153.

Each of the first agitating operation S151 and the second agitating operation S155 may include an operation of rotating the agitator 7 to an angle less than 360 degrees in the clockwise direction and an operation of rotating the agitator 7 to an angle less than 360 degrees in the counterclockwise direction.

In the second motion execution operation S15, the first agitating operation S151, the first filtering operation S153 and the second agitating operation S155 are preferably performed in sequence, and the second motion execution operation S15 may be successively performed twice or more.

Since the second motion execution operation S15 is a process of determining the washing performance, the second motion execution operation S15 is preferably performed for 70-90% of the period of time that is taken to perform the washing operation S10.

After the completion of the second motion execution operation S15, the method according to the present invention performs the third motion execution operation S17 and the water discharge operation S19.

The third motion execution operation S17 may include a second filtering operation S171 of rotating only the agitator 7 to an angle of 360 degrees or more in one direction selected from among the clockwise direction and the counterclockwise direction so as to supply water to the filter 53, and a second water flow creation operation S173 of rotating both the agitator 7 and the drum 4 in the same direction so as to create water flow. In the second filtering operation S171, the agitator 7 may be controlled in the same manner as in the first filtering operation S153.

Although the second water flow creation operation S173 is identical to the first water flow creation operation S133 in that the agitator 7 and the drum 4 are rotated in the same direction, there is a difference between the two operations in that the rotational speeds of the drum 4 and the agitator 7, which are set to the second water flow creation operation S173, are lower than the rotational speeds of the drum 4 and the agitator 7, which are set to the first water flow creation operation S133. In other words, the water in the tub 3 creates water flow circulating along the circumferential surface of the tub body 31 (water flow circulating along the circumferential surface of the tub 3 so as not to be introduced into the drum port 42) in the second water flow creation operation S173.

The second filtering operation S171 and the second water flow creation operation S173 are preferably performed in sequence, and the water discharge operation S19, which is intended to discharge the water contained in the tub body 31 to the outside of the cabinet 1, is preferably performed in conjunction with the second water flow creation operation S173.

The reason why the water discharge operation S19 is performed in conjunction with the second water flow creation operation S173 is to prevent contaminants and lint, which are separated from laundry, from remaining on the inner circumferential surface of the tub body 31 or the drum body 41 during water discharge. To this end, the start time of the second water flow creation operation S173 is preferably set to be before the initiation of the water discharge operation S19, and the ending time of the second water flow creation operation S173 is preferably set to be before the completion of the water discharge operation S19.

After the completion of the above-described washing operation S10, the method according to the present invention performs the first dewatering operation S30. The first dewatering operation S30 is a process of rotating the drum 4 only in one direction selected from among the clockwise direction and the counterclockwise direction so as to separate water and impurities from laundry using centrifugal force. In the course of the first dewatering operation S30, the controller may activate the pump 617 so as to discharge water and impurities, which are separated from laundry, to the outside of the cabinet 1.

After the completion of the first dewatering operation S30, the method according to the present invention performs the rinsing operation S50. The rinsing operation S50 may be defined as an operation of supplying water to the tub 3 so as to remove impurities and detergent remaining in laundry.

The rinsing operation S50 includes a first water supply for rinsing operation (a first water supply operation) S51, a fourth motion execution operation S53, a second water supply for rinsing operation (a second water supply operation) S54 of additionally supplying water to the tub 3, a fifth motion execution operation S55 and a water discharge operation S57.

The first water supply for rinsing operation S51 is a process in which the controller performs control of the valve 613 so as to supply water to the tub 3.

The fourth motion execution operation S53 is a process of filtering impurities that may remain in laundry or the tub 3 even after the completion of the third motion execution operation S17 and the water discharge operation S19. The fourth motion execution operation S53 includes a filtering for rinsing operation S533.

The filtering for rinsing operation S533 is a process of rotating only the agitator 7 to an angle of 360 degrees or more so as to supply water to the filter 53, thereby filtering contaminants, lint and the like contained in the water.

As illustrated in FIG. 4, in the filtering for rinsing operation S533, the agitator 7 is rotated only in one direction selected from among the clockwise direction and the counterclockwise direction, and the rotational speed of the agitator 6 should be set so as to create sufficient water pressure to raise the water to the level of the filter 53.

The filtering for rinsing operation S533 is performed after the completion of the first dewatering operation S30. In the first dewatering operation S30, laundry remains in the state of being in close contact with the inner circumferential surface of the drum 4 due to the centrifugal force. Accordingly, when the filtering for rinsing operation S533 is performed without a process of separating laundry, which is in close contact with the inner circumferential surface of the drum 4, from the drum 4, there may be a problem whereby impurities (contaminants, lint and the like) trapped between the laundry and the inner circumferential surface of the drum 4 may not be filtered even by the filtering for rinsing operation S533.

In order to solve the above problem, the fourth motion execution operation S53 may further include a dispersion for rinsing operation S531, which is performed before the initiation of the filtering for rinsing operation S533.

The dispersion for rinsing operation S531 is a process of rotating only the agitator 7 to an angle less than 360 degrees so as to create water flow in the drum 4. Accordingly, laundry can be separated from the inner circumferential surface of the drum 4 by means of water flow created in the dispersion for rinsing operation S531 or the frictional force between the agitator 7 and the laundry.

The dispersion for rinsing operation S531 may be initiated after the completion of the first water supply for rinsing operation S51 or may be initiated during the first water supply operation S51.

If the agitator 7 can provide laundry with high frictional force in the dispersion for rinsing operation S531, it will be easy to separate contaminants, lint and the like, which remains in laundry or on the surface of the laundry, from the laundry.

The frictional force, which is provided to laundry by the agitator 7 in the dispersion for rinsing operation S531, may be maximized by controlling the amount of water supplied from the tub 3 in the first water supply for rinsing operation S51. The reason for this is because the agitator 7 can directly strike laundry when the amount of water contained in the tub 3 is small.

To this end, the amount of water supplied to the tub 3 in the first water supply for rinsing operation S51 is preferably set so as to supply water to a level lower than the reference level that is set for the rinsing of laundry.

In order to determine the level of water supplied to the tub 4, the method according to the present invention may further include a laundry amount determination operation (not shown) of determining an amount of laundry (laundry amount) contained in the drum 4, prior to the first water supply operation S51. The laundry amount determination operation is intended to determine a laundry amount from the amount of current supplied to the stator 911 in order to rotate the drum 4 to a predetermined angle.

The rotational speed of the agitator 7 set for the dispersion for rinsing operation S531, is preferably set to be lower than the rotational speed of the agitator 7 that is set for the filtering for rinsing operation S533.

In order to increase the effect of the dispersion for rinsing operation S531, the dispersion for rinsing operation S531 may include an operation of rotating only the agitator 7 to an angle less than 360 degrees in the clockwise direction, and an operation of rotating only the agitator 7 to an angle less than 360 degrees in the counterclockwise direction.

After the completion of the filtering for rinsing operation S533, the fourth motion execution operation S53 may include a first agitating for rinsing operation S535 for separating impurities from laundry by creating a water current in the drum 4.

The first agitating for rinsing operation S535 is a process of rotating only the agitator 7 to an angle less than 360 degrees at a rotational speed that is higher than the rotational speed of the agitator 7 set for the dispersion for rinsing operation S531 but is lower than the rotational speed of the agitator 7 set for the filtering for rinsing operation S533.

In order to improve the rinsing performance, the first agitating for rinsing operation S535 may include an operation of rotating the agitator 7 to an angle less than 360 degrees in the clockwise direction, and an operation of rotating the agitator 7 to an angle less than 360 degrees in the counterclockwise direction.

Unlike the above construction, the first agitating for rinsing operation S535 may also be performed between the dispersion for rinsing operation S531 and the filtering for rinsing operation S533. In this case, the filtering performance obtained through the filtering for rinsing operation S533 is improved.

In the fourth motion execution operation S53, the dispersion for rinsing operation S531, the filtering for rinsing operation S533 and the first agitating for rinsing operation S535 are preferably performed in sequence. The fourth motion execution operation S53 may be successively performed twice or more. The fourth motion execution operation S53 is the core process of determining the rinsing performance.

After the completion of the fourth motion execution operation S53, the method according to the present invention performs the second water supply for rinsing operation S54 of operating the controller so as to supply the tub 3 with water to a level higher than the reference level (a water level, which is preliminarily set for rinsing of the determined laundry amount) by controlling the valve 613 and a water level detector (not shown).

After the completion of the second water supply for rinsing operation S54, the fifth motion execution operation S55 and the water discharge operation S57 are performed.

The fifth motion execution operation S55 may include a second agitating for rinsing operation S551 of rotating only the agitator 7 to an angle less than 360 degrees, and a third water flow creation operation S553 of rotating the agitator 7 and the drum 4 to an angle of 360 degrees or more in the same direction to create water flow.

Preferably, the rotational speed of the agitator 7 that is set for the second agitating for rinsing operation S551, is higher than the rotational speed of the agitator 7 that is set for the dispersion for rinsing operation S531 but is lower than the rotational speed of the agitator 7 that is set for the filtering for rinsing operation S533.

The second agitating for rinsing operation S551, which is a process of creating water flow in the drum 4 so as to separate impurities from laundry, may be controlled in the same manner as the first agitating for rinsing operation S535.

The third water flow creation operation S553 is a process of rotating the agitator 7 and the drum 4 in the same direction so as to create water flow circulating along the circumferential surface of the tub body 31.

The second agitating for rinsing operation S551 and the third water flow creation operation S553 are preferably performed in sequence, and the water discharge operation S57, which is intended to discharge the water contained in the tub body 31 to the outside, is preferably performed in conjunction with the third water flow creation operation S553.

The reason why the water discharge operation S57 is performed in conjunction with the third water flow creation operation S553 is to prevent contaminants and lint from remaining on the inner circumferential surface of the tub body 31 or the drum body 41 during the water discharge operation. To this end, preferably, the starting time of the third water flow creation operation S553 is set to be before the initiation of the water discharge operation S57, and the starting time of the third water flow creation operation 553 is set to be before the completion of the water discharge operation S57.

As is apparent from the above description, the present invention provides a laundry treatment apparatus and a method of controlling the same, which are able to improve washing performance, rinsing performance and filtering performance.

The present invention provides a laundry treatment apparatus and a method of controlling the same, which are able to improve washing performance and filtering performance by performing an operation of dispersing laundry in a drum before the initiation of water flow creation operation for improvement of the washing performance or after the completion of the water flow creation operation.

The present invention provides a laundry treatment apparatus and a method of controlling the same, which are able to improve filtering performance by performing an operation of dispersing laundry or untangling the laundry before the initiation of water filtering operation or after the completion of the water filtering operation.

The present invention provides a laundry treatment apparatus and a method of controlling the same, which are able to prevent impurities from remaining in a tub or a drum by creating water flow in the tub during the discharge of the water contained in the tub.

The present invention provides a laundry treatment apparatus and a method of controlling the same, which are able to minimize lint remaining in a drum, a tub or laundry.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

Accordingly, the present invention is directed to a laundry treatment apparatus and a method of controlling the same that substantially obviate one or more problems due to limitations and disadvantages of the related art.

An object of the present invention is to provide a laundry treatment apparatus and a method of controlling the same, which are able to improve washing performance, rinsing performance and filtering performance.

Another object of the present invention is to provide a laundry treatment apparatus and a method of controlling the same, which are able to improve washing performance and filtering performance by dispersing laundry in a drum before or after water flow creation operation.

Still another object of the present invention is to provide a laundry treatment apparatus and a method of controlling the same, which are able to improve filtering performance by dispersing laundry or untangling the tangled laundry before or after an operation of filtering water.

A further object of the present invention is to provide a laundry treatment apparatus and a method of controlling the same, which are able to prevent impurities from remaining in a tub or a drum by creating water flow in the tub during discharge of the water contained in the tub.

Another further object of the present invention is to provide a laundry treatment apparatus and a method of controlling the same, which are able to minimize lint remaining in a drum, a tub or laundry.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a method of controlling a laundry treatment apparatus including a tub having a space for containing water, a drum rotatably disposed in the tub, the drum having a space for containing laundry and a drum port formed in an upper wall thereof, a chamber for guiding water, which is discharged to an outside of the drum, to an inside of the drum, an agitator rotatably disposed in the drum so as not only to create water flow in the drum but also to transfer water to the chamber, and a filter disposed at a level higher than the agitator so as to filter water introduced into the chamber, includes a dewatering operation of rotating the drum only in one direction among a clockwise direction and a counterclockwise direction so as to separate water from water contained in the drum; a first water supply operation of supplying water to the tub; a dispersion operation of rotating only the agitator to an angle less than 360 degrees so as to disperse laundry in the drum; a filtering operation of rotating only the rotator to an angle of 360 degrees or more at a rotational speed that is higher than a rotational speed of the agitator set for the dispersion operation, so as to supply water to the chamber, and of filtering water through the filter; and a first agitating operation of rotating only the agitator to an angle less than 360 degrees at a rotational speed that is higher than the rotational speed of the agitator set for the dispersion operation but is lower than the rotational speed set for the filtering operation.

The dispersion operation, the filtering operation and the first agitating operation may be sequentially performed.

The dispersion operation may be initiated during the first water supply operation.

The dispersion operation may include rotating the agitator in a clockwise direction and rotating the agitator in a counterclockwise direction.

The first agitating operation may include rotating the agitator in a clockwise direction and rotating the agitator in a counterclockwise direction.

The method may further include, after the first agitating operation, a second water supply operation of supplying water to the tub; a second agitating operation of rotating only the agitator to an angle less than 360 degrees at a rotational speed that is higher than the rotational speed of the agitator set for the dispersion operation but is lower than the rotational speed of the agitator set for the filtering operation; a second agitating operation of rotating the agitator and the drum to an angle of 360 degrees or more in the same direction so as to create water flow circulating along a circumferential surface of the tub; and a water discharge operation of discharging water contained in the tub.

The second agitating operation and the water flow creation operation may be sequentially performed.

The water flow creation operation may be performed concurrently with the water discharge operation.

The water flow creation operation may be initiated before initiation of the water discharge operation and may be completed before completion of the water discharge operation.

The method may further include a laundry amount determination operation of measuring an amount of laundry contained in the drum before the first water supply operation, wherein the first water supply operation supplies water to a level lower than a reference level, which is set based on the amount of laundry measured in the first water supply operation, and wherein the second water supply operation supplies water to a level higher than the reference level.

It is to be understood that both the foregoing general description and the following detailed description of the present invention are exemplary and explanatory and are intended to provide further explanation of the invention as claimed.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method of controlling a laundry treatment apparatus that includes a tub having a space for containing water, a drum rotatably disposed in the tub, the drum having a space for containing laundry and a drum port provided at an upper wall thereof, a chamber to guide water, an agitator rotatably disposed in the drum to create water flow in the drum and to transfer water to the chamber, and a filter disposed at a level higher than the agitator to filter water introduced into the chamber, the method comprising:

performing a dewatering operation, after water discharge operation, by rotating the drum only in one of a clockwise direction and a counterclockwise direction to separate water from in the drum;

performing a first water supply operation for rinsing operation by supplying water to the tub;

performing a dispersion operation by rotating the agitator to an angle that is less than 360 degrees to disperse laundry in the drum, the dispersion operation to separate laundry from an inner circumferential surface of the drum by the water flow;

performing a filtering operation by rotating the agitator to an angle of 360 degrees or more at a rotational speed that is higher than a rotational speed of the agitator set for the dispersion operation, to supply water to the chamber, and to filter water through the filter;

performing a first agitating operation by rotating the agitator to an angle that is less than 360 degrees at a rotational speed that is higher than the rotational speed of the agitator set for the dispersion operation and is lower than the rotational speed of the agitator set for the filtering operation, after performing the first agitating operation:

performing a second water supply operation by supplying water to the tub;

performing a second agitating operation by rotating the agitator to an angle less than 360 degrees at a rotational speed that is higher than the rotational speed of the agitator set for the dispersion operation and is lower than the rotational speed of the agitator set for the filtering operation;

performing a water flow creation operation by rotating, in a same direction, the agitator and the drum to an angle of 360 degrees or more to create water flow at a circumferential surface of the tub; and performing a water discharge operation by discharging water in the tub, wherein initiation of performing the dispersion operation occurs during the performing of the first water supply operation.

2. The method according to claim 1, wherein the dispersion operation, the filtering operation and the first agitating operation are to be sequentially performed.

3. The method according to claim 1, wherein performing the dispersion operation includes:

rotating the agitator in a clockwise direction; and rotating the agitator in a counterclockwise direction.

4. The method according to claim 1, wherein performing the first agitating operation includes:

rotating the agitator in a clockwise direction; and rotating the agitator in a counterclockwise direction.

5. The method according to claim 1, wherein the performing of the second agitating operation includes rotating only the agitator to the angle less than 360 degrees.

6. The method according to claim 1, wherein performing the second agitating operation and performing the water flow creation operation are to be sequentially performed.

7. The method according to claim 6, wherein at least a portion of performing the water flow creation operation is performed concurrently with at least a portion of performing the water discharge operation.

8. The method according to claim 6, wherein initiation of performing the water flow creation operation is before initiation of performing the water discharge operation, and performing the water flow creation operation is completed before completion of performing the water discharge operation.

9. The method according to claim 1, further comprising:

prior to performing the first water supply operation, performing a laundry amount determination operation by determining an amount of laundry in the drum, wherein the first water supply operation supplies water to a level that is lower than a reference level set based on the determined amount of laundry, and wherein the second water supply operation supplies water to a level that is higher than the reference level.

10. The method according to claim 1, wherein performing the dispersion operation includes rotating only the agitator to the angle that is less than 360 degrees, wherein performing the filtering operation includes rotating only the agitator to the angle of 360 degrees or more, and wherein performing the first agitation operation includes rotating only the agitator to the angle that is less than 360 degrees.

11. A method of controlling a laundry treatment apparatus that includes a tub, a drum rotatably disposed in the tub and having a space for containing laundry and a drum port, a chamber to guide water, an agitator rotatably disposed in the drum, and a filter, the method comprising:

rotating the drum, after discharging water, only in one of a clockwise direction and a counterclockwise direction to separate water from in the drum;

supplying first water for rinsing to the tub;

rotating only the agitator to an angle that is less than 360 degrees to disperse laundry in the drum, and to be configured to separate laundry from an inner circumferential surface of the drum by water flow;

rotating only the agitator to an angle of 360 degrees or more at a rotational speed that is higher than a rotational speed of the agitator set for the rotating of only the agitator to the angle that is less than 360 degrees, to supply water to the chamber, and to filter water through the filter;

rotating only the agitator to an angle that is less than 360 degrees at a rotational speed that is higher than the rotational speed of the agitator set for the rotating of only the agitator to the angle that is less than 360 degrees and is lower than the rotational speed of the agitator set for the rotating of only the agitator to the angle of 360 degrees or more, after rotating of only the agitator to an angle that is less than 360 degrees:

supplying second water to the tub;

rotating the agitator to an angle less than 360 degrees at a rotational speed that is higher than the rotational speed of the agitator set for the rotating of only the agitator to an angle that is less than 360 degrees to disperse laundry in the drum and is lower than the rotational speed of the agitator set for the rotating of only the agitator to the angle of 360 degrees or more;

rotating, in a same direction, the agitator and the drum to an angle of 360 degrees or more to create water flow at a circumferential surface of the tub; and discharging water in the tub, wherein initiation of rotating of only the agitator to the angle that is less than 360 degrees occurs during the supplying of the first water to the tub.

12. The method according to claim 11, wherein the rotating of only the agitator to an angle that is less than 360 degrees to disperse laundry in the drum includes:

rotating the agitator in a clockwise direction; and rotating the agitator in a counterclockwise direction.

13. The method according to claim 11, wherein rotating of only the agitator to the angle that is less than 360 degrees at a rotational speed that is higher than the rotational speed of the agitator set for the rotating of only the agitator to the angle that is less than 360 degrees includes:

rotating the agitator in a clockwise direction; and rotating the agitator in a counterclockwise direction.

14. The method according to claim 11, wherein the rotating of the agitator to the angle less than 360 degrees includes rotating of only the agitator to the angle less than 360 degrees.

15. The method according to claim 11, wherein initiation of rotating the agitator and the drum to the angle of 360 degrees or more is before initiation of discharging water in the tub, and rotating the agitator and the drum to the angle of 360 degrees or more is completed before completion of discharging water in the tub.

16. The method according to claim 11, further comprising:

prior to the supplying of first water to the tub, determining an amount of laundry in the drum, wherein the supplying of first water to the tub supplies water to a level that is lower than a reference level set based on the determined amount of laundry, and wherein the supplying of second water supplies water to a level that is higher than the reference level.

* * * * *